US005749814A

United States Patent [19]

Chen

[11] Patent Number: 5,749,814

[45] Date of Patent: May 12, 1998

[54] STRUCTURE OF MATCHING WEIGHTS FOR A HEALTH EXERCISE MACHINE

[75] Inventor: Chao-Yueh Chen, Taipei, Taiwan

[73] Assignee: Fitness Quest, Inc., Canton, Ohio

[21] Appl. No.: 767,510

[22] Filed: Dec. 16, 1996

[51] Int. Cl.[6] ..... A63B 21/06

[52] U.S. Cl. ..... 482/93; 482/140; 482/107; 473/437

[58] Field of Search ..... 482/93, 94, 98, 482/106–109, 105, 140; 473/256, 437; 24/500, 566, 567

[56] References Cited

U.S. PATENT DOCUMENTS

| | | | |
|---|---|---|---|
| D. 260,796 | 9/1981 | Uyeda | D21/196 |
| D. 337,801 | 7/1993 | Tandberg | D21/196 |
| 2,753,653 | 7/1956 | Osterberg | 24/567 X |
| 4,588,191 | 5/1986 | Stewart | 473/256 |
| 4,743,017 | 5/1988 | Jaeger | 482/108 |
| 4,863,158 | 9/1989 | Tassone . | |
| 4,898,380 | 2/1990 | Kobrin . | |
| 5,169,372 | 12/1992 | Tecco | 482/140 |
| 5,300,005 | 4/1994 | Wang | 482/142 |
| 5,577,987 | 11/1996 | Brown | 482/140 |

FOREIGN PATENT DOCUMENTS

| | | | |
|---|---|---|---|
| 1006179 | 4/1952 | France | 24/567 |

*Primary Examiner*—Richard J. Apley
*Assistant Examiner*—John Mulcahy
*Attorney, Agent, or Firm*—Sand & Sebolt

[57] ABSTRACT

An add on weight for removable attachment to an exercise machine or weight set. Two arch-shaped metallic blocks each have opposed sloping surfaces in which spring sets are mounted biasing the two sloping surfaces apart while biasing extended neck parts adjacent a bottom opening toward each other whereby the weights can be clamped onto the machine or weights. The arch-shaped blocks are sealed in an outer layer of plastic material.

7 Claims, 3 Drawing Sheets

FIG-1
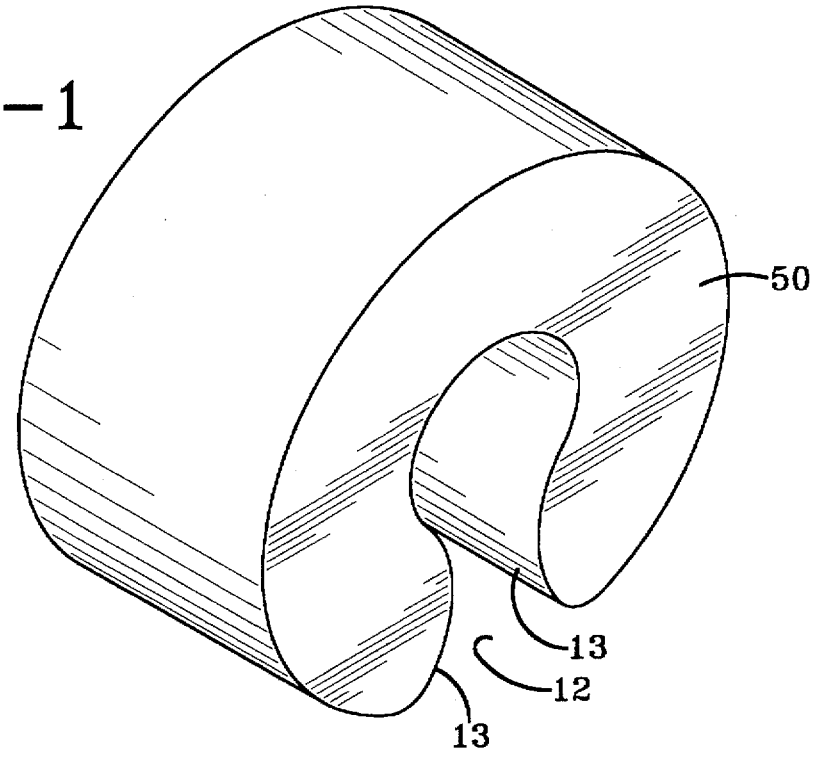
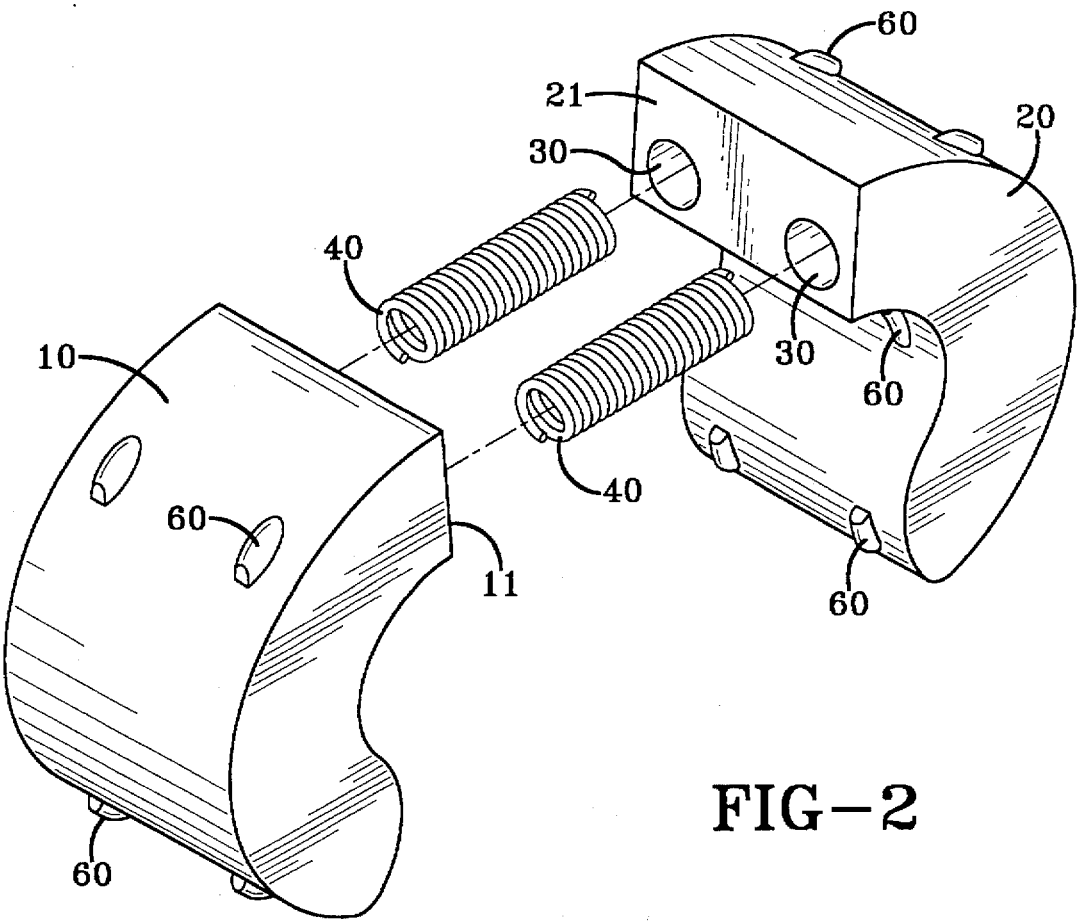
FIG-2

STRUCTURE OF MATCHING WEIGHTS FOR A HEALTH EXERCISE MACHINE

BACKGROUND OF THE INVENTION

TECHNICAL FIELD

This invention is about the structure of a type of matching weights for a health exercise machine. The major body is mainly composed of two opposing arch-shaped metallic blocks, at where the two blocks contacting each other are two surfaces sloping from top to bottom. There are a set of holes (two) on each of the sloping surfaces in which two springs are set. The outside of the arch-shaped blocks are sealed with a plastic material. When in use, the opening at the bottom of the weights can be clamped onto the health exercise or weight lifting machine. They are easily clamped on without any slippage of the weights and with the advantage that there is no need to dismantle the original equipment.

BACKGROUND INFORMATION

This invention is about the structure of matching weights for a health exercise machine. The weights of this invention can be easily clipped onto the lying-down or the sitting-up health exercise machine or the weight lifting machine with no slippage and no need to dismantle the original machine to change the weights. It is a design of practicality.

Since it is becoming more and more difficult to find outdoor exercise space, people are turning to indoor exercise facilities which are sprouting up like bamboo shoots after a spring rain.

The indoor exercise machines have a very close relationship with the people. The exercise machines are used by the general population as a healthy athletic activity. Therefore, it goes without saying about the practicality of health exercise machines.

However, in the case of traditionally used health exercise machines, such as the lying-down, the sifting-up exercising or a weight lifting machine, they are the fixed types without ways to adjust the training weights. The above mentioned lying-down and sitting-up exercise machine is not suited for those who need different weights for training.

The general weight lifting machines for health exercise purpose are those with fixed weights. It is inconvenient for those wanting different weights for training. Therefore, the above mentioned traditional exercise machines are not sufficient for practical use and need to be improved.

The inventor has devoted much thought towards the deficiency of the above mentioned health exercise and weight lifting machines and aggressive research towards their improvement. After long periods of effort, testing and development, this invention is designed.

SUMMARY OF THE INVENTION

The main purpose of this invention is to provide the structure of a type of matching weights for a health exercise machine. The major body is composed of two arch-type opposing metallic blocks, at where the two blocks contact each other, are two surfaces sloping from top to bottom. There are a set of holes (two) in each of the sloping surface in which two springs are set. The outside of the arch-type blocks are sealed with plastic material. When in use, the bottom opening of the weights can be clipped onto the lying-down or sitting-up exercise or weight lifting machine without slippage and without the need to dismantle the original machine. It is a new, advanced and practical design.

The following diagrams provide further elucidation of the characteristic contents and practical use of this invention for the examiners. They are illustrated below.

BRIEF DESCRIPTION OF THE DRAWINGS

FIG. 1—A three dimensional look of this invention.

FIG. 2—A three dimensional dissect diagram of this invention.

DESCRIPTION OF THE PREFERRED EMBODIMENT

Figure 3:
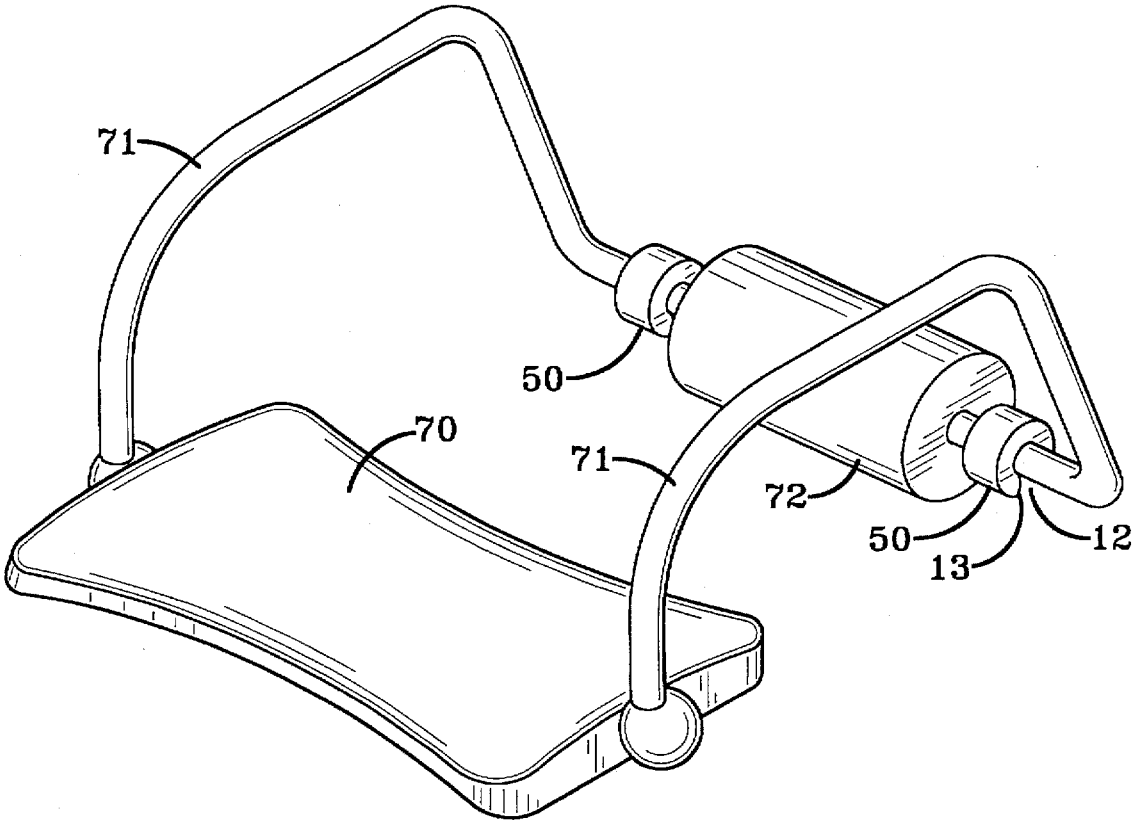
FIG. 3—The diagram of the actual application of this invention on a lying-down, sitting-up exercise machine.

| | |
|---|---|
| (10) Arch-shaped blocks | (11) Sloping surfaces |
| (12) Opening | (13) Stretchable neck part |
| (20) Arch-shaped blocks | (21) Sloping surfaces |
| (30) Holes | (40) Springs |
| (50) Plastic material | (60) Convex particles |
| (70) Base plate | (71) Body frame |
| (72) Head support | (80) Weight lifting machine |

This invention is the structure of a type of matching weights for a health exercise machine (as shown in FIG. 1 and 2). It can be seen from these figures that the entire structure of this invention is made of two arch-shaped metallic blocks (10) and (20) opposing each other. At the contacting surfaces of the arch-shaped blocks (10) and (20), there are surfaces sloping from top to bottom (11) and (21). There are a set of holes (two) (30) in each of the sloping surfaces. There are springs (40) placed inside those holes. On the outside of the arch-shaped blocks (10) and (20), it is sealed with a plastic material (50). On the surfaces of the arch-shaped blocks (10) and (20), there are adequately positioned several convex particles (60). These convex particles (60) are positioned inside the molding, and enable the plastic material (50) to cover the outside of the arch-shaped blocks (10) and (20) in an even thickness.

These weights are in a reverse U shape. There is an opening (12) at the bottom of the weight. On both sides of the opening (12), there are separately stretchable neck portions (13).

Figure 5:
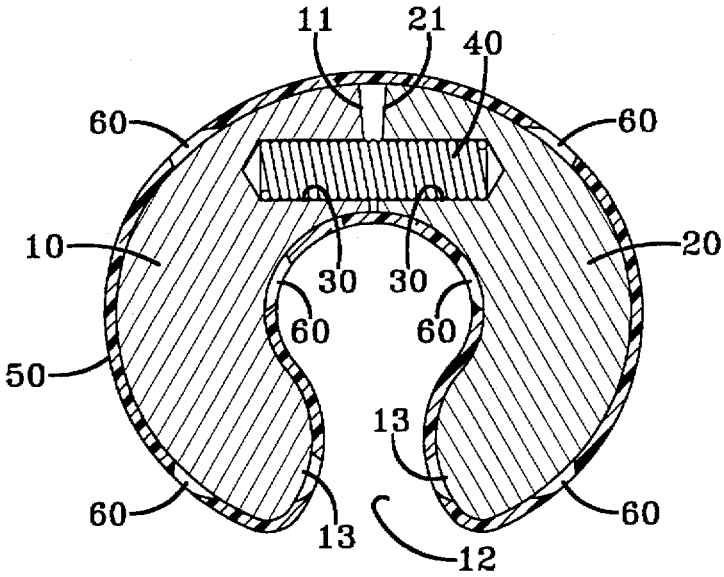
FIG. 5—The comprehensive cross-section diagram of this invention.

When the above mentioned structure is put together (as shown in FIG. 3) and put to use, this invention can be applied to the lying-down and sitting-up exercise machine. That machine has a U shape base plate (70), at each side of the base plate (70), there is a U shape, as viewing from above, frame (71), and a head support (72) attached to the frame (71). When the user lies on the base plate (70), the user's head leans on the head support (72). When the exerciser's hands hold the two sides of the frame (71), the user can do a lying-down and sifting-up motion. When the exerciser wishes to increase the weight for training, the weights of this invention can be spread apart at the opening (12) (as shown in FIG. 5), and clipped onto each end of the frame (71) of the head support part (72). This has the advantage of easy fitting, non-slipping and with no need to dismantle the equipment.

Figure 4:
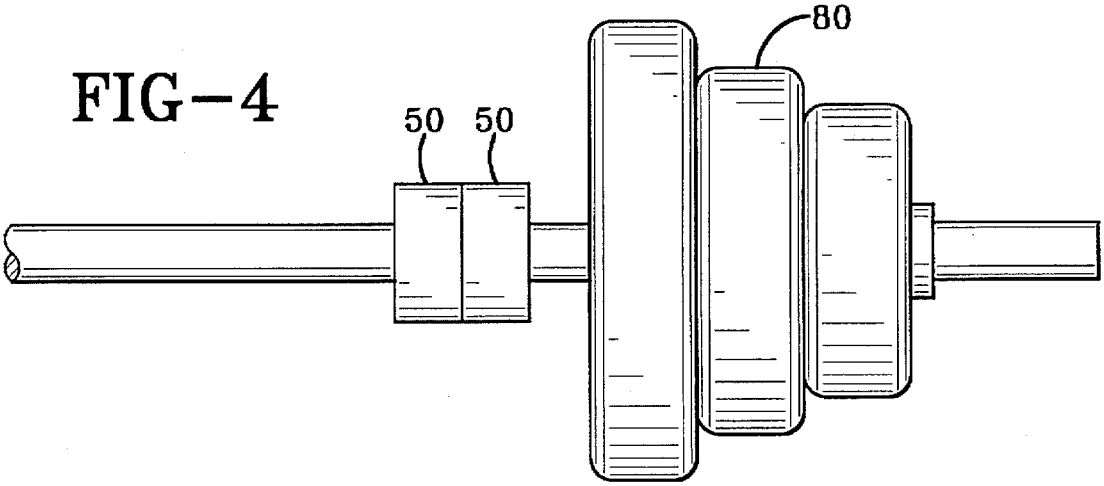
FIG. 4—The planar diagram of the actual application of this invention on a weight lifting machine.
Figure 6:
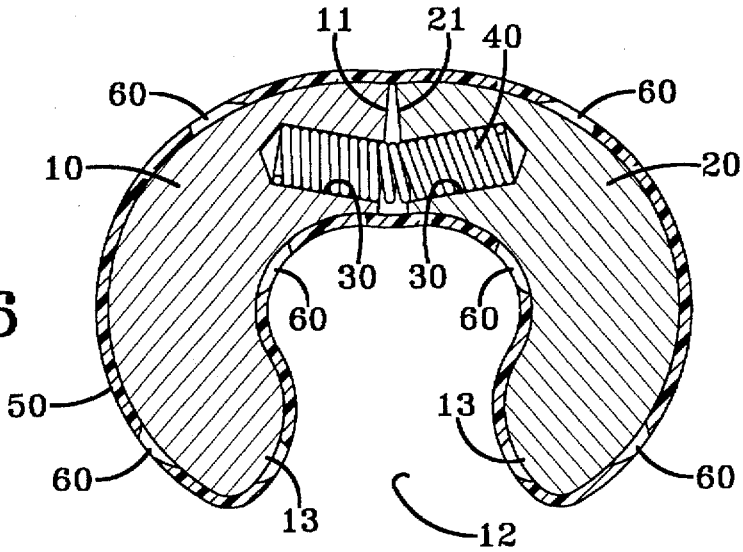
FIG. 6—The comprehensive cross-section action diagram of this invention.

FIG. 4 shows an actual example of applying the weight of this invention on a weight lifting machine. When the exerciser wishes to increase the weight of the weight lifting machine (80), the user clips the appropriate weights onto the central bar of the weight lifting machine (80). The weights can be spread open at the opening (12) (as shown in FIG. 5 and 6), and clipped onto the central bar of the weight lifting machine (80). This allows the user to change to different weights for training purpose. This also has the advantage of easy fitting, non-slipping and with no need to dismantle the original equipment.

Hence, to summarize the above illustrations, the advantages of this invention are as follows:

When this invention is used, the weights can be easily clipped onto the lying-down and sitting-up health exerciser or weight lifting machine through the opening (12) at the bottom of the weights, without slipping of the weights and no need to dismantle the original equipment.

I claim:

1. An add-on weight including:

a pair of arch-shaped weight blocks having opposed top end surfaces and bottom neck portions, each of said end surfaces having a top and a bottom wherein the opposed end surfaces slope from the top to the bottom thereof, and said neck portions forming an opening therebetween; and spring means mounted in and extending between the end surfaces for biasing the neck portions toward each other for clipping the weight on a portion of a health exercise machine which extends through the opening.

2. The weight defined in claim 1 wherein the spring means includes a pair of compression coil springs; and in which a pair of holes is formed side by side in each of the end surfaces for receiving ends of the springs therein.

3. The weight defined in claim 1 wherein an outer layer of plastic encapsulates the arch-shaped blocks and spring means.

4. The weight defined in claim 3 wherein convex particles are positioned on inner surfaces of the arch-shaped blocks.

5. The weight defined in claim 1 in combination with a sitting-up exercise machine having a frame; and in which said frame extends through the opening between the neck portions of the add-on weight.

6. The weight defined in claim 1 in combination with a weight lifting machine having a bar; and in which said bar extends through the opening between the neck portions of the add-on weight.

7. The weight defined in claim 1 in which the arch-shaped blocks are formed of metal.

* * * * *